US010202181B2

(12) United States Patent
Suzuki et al.

(10) Patent No.: US 10,202,181 B2
(45) Date of Patent: Feb. 12, 2019

(54) ELECTRIC PROPULSION DEVICE

(71) Applicant: YAMAHA HATSUDOKI KABUSHIKI KAISHA, Shizuoka-ken (JP)

(72) Inventors: Takayoshi Suzuki, Shizuoka-Ken (JP); Noriyoshi Hiraoka, Shizuoka-Ken (JP); Akihiro Onoue, Shizuoka-Ken (JP); Atsushi Kumita, Shizuoka-Ken (JP); Yoshiaki Tasaka, Shizuoka-Ken (JP)

(73) Assignee: YAMAHA HATSUDOKI KABUSHIKI KAISHA, Iwata-Shi, Shizuoka-Ken (JP)

( * ) Notice: Subject to any disclaimer, the term of this patent is extended or adjusted under 35 U.S.C. 154(b) by 579 days.

(21) Appl. No.: 14/746,167

(22) Filed: Jun. 22, 2015

(65) Prior Publication Data

US 2016/0090166 A1 Mar. 31, 2016

(30) Foreign Application Priority Data

Sep. 26, 2014 (JP) ..... 2014-196964

(51) Int. Cl.
*B63H 23/24* (2006.01)
*B63H 5/15* (2006.01)
(Continued)

(52) U.S. Cl.
CPC ..... *B63H 21/17* (2013.01); *B63H 5/14* (2013.01); *B63H 5/15* (2013.01); *B63H 20/00* (2013.01);
(Continued)

(58) Field of Classification Search
CPC . B63H 5/14; B63H 5/15; B63H 20/00; B63H 21/17; B63H 23/24;
(Continued)

(56) References Cited

U.S. PATENT DOCUMENTS 4,200,055 A * 4/1980 Siegel ..... B63H 20/007 440/5
5,016,553 A * 5/1991 Spencer ..... B63H 25/46 114/151
(Continued)

FOREIGN PATENT DOCUMENTS

| | | | | |
|---|---|---|---|---|
| EP | 0111908 A2 | 6/1984 | | |
| FR | 1529806 A * | 6/1968 | ..... | B63H 5/125 |
| JP | 2013-100013 A | 5/2013 | | |
| WO | WO 2012-062699 A1 | 5/2012 | | |

OTHER PUBLICATIONS

Extended European Search Report dated Feb. 29, 2016.

*Primary Examiner* — Richard A Edgar
*Assistant Examiner* — Alexander A White
(74) *Attorney, Agent, or Firm* — Rabin & Berdo, P.C.

(57) ABSTRACT

An electric propulsion device includes a duct having a cylindrical shape and that includes a stator. A rim includes a rotor rotatable relative to the duct, and a plurality of fins. A bracket supports the duct so as to allow the duct to turn about a turning axis that intersects with the rotation axis of the rim, and a turning actuator that integrally turns the duct and the rim. The turning actuator is fixed to the bracket, and the duct is turnable relative to the bracket.

20 Claims, 11 Drawing Sheets

(51) Int. Cl.

| | |
|---|---|
| ***B63H 21/17*** | (2006.01) |
| ***B63H 5/14*** | (2006.01) |
| ***B63H 20/00*** | (2006.01) |
| *B63H 23/00* | (2006.01) |

(52) U.S. Cl.
CPC ..... *B63H 23/24* (2013.01); *B63H 2023/005* (2013.01)

(58) Field of Classification Search
CPC . B63H 2023/005; F04D 3/005; F04D 13/024; F04D 13/06; F04D 25/06; F04D 25/0606; F04D 25/0686; F04D 25/0693; F04D 29/048; F04D 29/186; F04D 29/548
See application file for complete search history.

(56) References Cited

U.S. PATENT DOCUMENTS

| | | | | |
|---|---|---|---|---|
| 5,306,183 | A * | 4/1994 | Holt | B63H 5/14 310/114 |
| 5,522,335 | A * | 6/1996 | Veronesi | B63H 5/125 114/151 |
| 6,579,133 | B1 * | 6/2003 | Harris | B63H 25/46 114/151 |
| 6,964,590 | B1 | 11/2005 | Ha | |
| 7,357,687 | B1 | 4/2008 | Gornstein et al. | |
| 7,530,319 | B1 | 5/2009 | Ha | |
| 8,956,195 | B2 | 2/2015 | Suzuki et al. | |
| 2012/0251353 | A1 | 10/2012 | Holesz | |

* cited by examiner

FIG.2 FIRST EMBODIMENT

FIG.15 SECOND EMBODIMENT
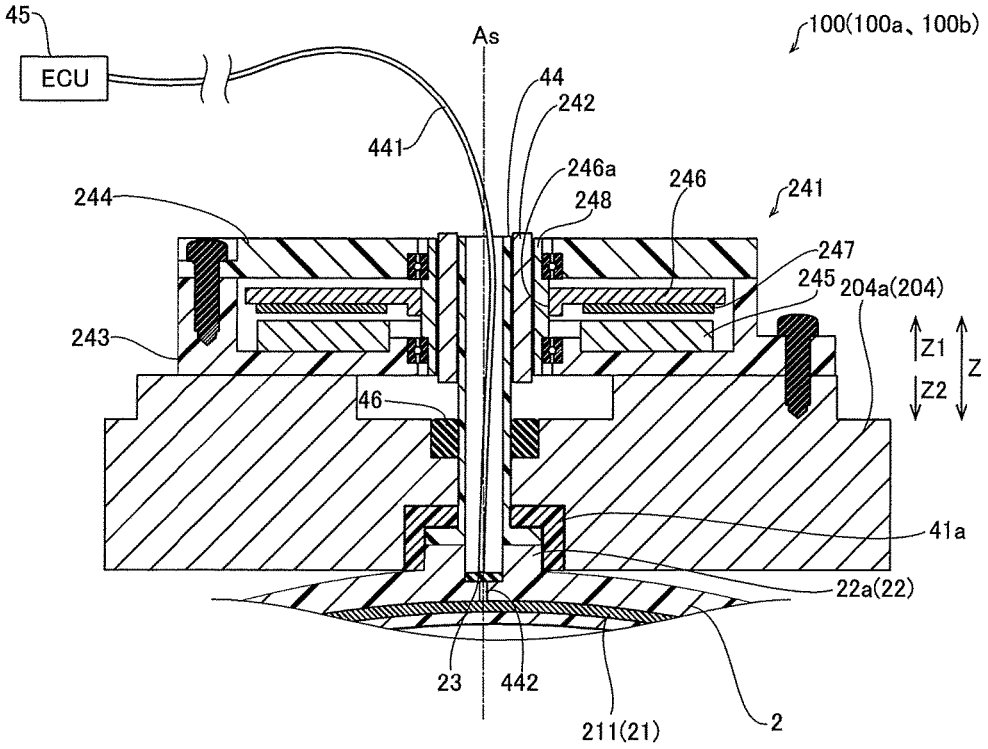
FIG.16
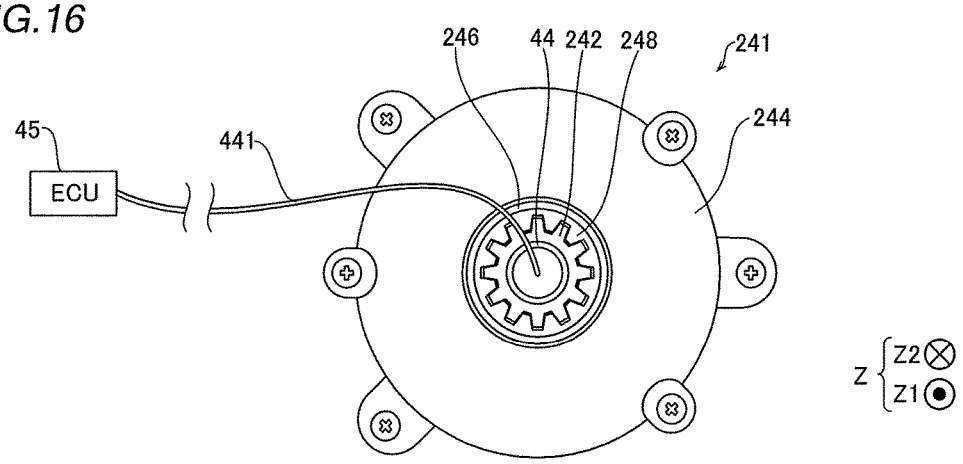

MODIFICATION

MODIFICATION

MODIFICATION

MODIFICATION

ELECTRIC PROPULSION DEVICE

CROSS-REFERENCE TO RELATED APPLICATION

The priority application number JP2014-196964, Electric Propulsion Device, Sep. 26, 2014, Takayoshi Suzuki, Noriyoshi Hiraoka, Akihiro Onoue, Atsushi Kumita, and Yoshiaki Tasaka, upon which this patent application is based is hereby incorporated by reference.

BACKGROUND OF THE INVENTION

Field of the Invention

The present invention relates to an electric propulsion device, and more particularly, it relates to an electric propulsion device including a duct and a rim.

Description of the Background Art

An electric propulsion device including a duct and a rim is known in general. Such an electric propulsion device is disclosed in U.S. Patent Application Publication No. 2012/0251353 and Japanese Patent Laying-Open No. 2013-100013, for example.

The aforementioned U.S. Patent Application Publication No. 2012/0251353 discloses an electric propulsion device including a motor and two propellers. One propeller generates propulsive force in a front-back direction, and the other propeller generates propulsive force in a right-left direction. The two propellers are arranged such that the rotation axes thereof are orthogonal to each other.

The aforementioned Japanese Patent Laying-Open No. 2013-100013 discloses an electric propulsion device including a duct that defines a stator and a rim that defines a rotor rotatable relative to the duct. This electric propulsion device includes a steering shaft that supports the duct so as to turn the duct about a turning axis that intersects with the rotation axis of the rim and a turning actuator that is fixed to the duct and rotates the steering shaft. The turning actuator integrally turns the duct and the rim through the steering shaft.

In the electric propulsion device described in the aforementioned U.S. Patent Application Publication No. 2012/0251353, the direction of generated propulsive force can be changed, but it is necessary to provide at least the two propellers. Therefore, the electric propulsion device is disadvantageously increased in size.

In the electric propulsion device described in the aforementioned Japanese Patent Laying-Open No. 2013-100013, the direction of generated propulsive force can be changed by integrally turning the duct and the rim, but it is necessary to provide the steering shaft. Therefore, the electric propulsion device is increased in size, and hence it is preferable to remedy this problem.

SUMMARY OF THE INVENTION

The present invention has been proposed in order to solve the aforementioned problems, and an object of the present invention is to provide an electric propulsion device that changes the direction of generated propulsive force while significantly reducing an increase in size.

An electric propulsion device according to an aspect of the present invention includes a duct of a cylindrical shape that defines a stator, a rim that defines a rotor rotatable relative to the duct and includes a plurality of fins, a bracket that supports the duct so as to allow the duct to turn about a turning axis that intersects with the rotation axis of the rim, and a turning actuator that integrally turns the duct and the rim. The turning actuator is fixed to the bracket, and the duct is turned relative to the bracket.

The electric propulsion device according to the aspect of the present invention is configured as hereinabove described, whereby the turning actuator integrally turns the duct and the rim so as to change the direction of generated propulsive force without providing a plurality of propellers. Furthermore, the duct is turned relative to the bracket (the duct is turned independently of the bracket) so as to change the direction of generated propulsive force. In addition, the turning actuator fixed to the bracket turns the duct relative to the bracket, and hence the height of the electric propulsion device in a vertical direction is significantly reduced, unlike the case where a steering shaft is provided so as to integrally turn the duct and the rim. Consequently, the direction of generated propulsive force is changed while significantly reducing an increase in the size of the electric propulsion device.

In the present invention, the bracket is a wide concept including a portion (a spacer case, for example) of an outboard motor, a portion of a boat body, etc.

The aforementioned electric propulsion device according to this aspect preferably further includes a driven gear mounted on the duct and a drive gear that drives the driven gear, and the turning actuator preferably drives the drive gear so as to integrally turn the duct and the rim. According to this structure, unlike the case where a steering shaft is provided, the turning actuator integrally turns the duct and the rim through the drive gear and the driven gear, and hence the height of the electric propulsion device in the vertical direction is significantly reduced.

In this case, the driven gear is preferably arranged above the duct in the vicinity of the duct. According to this structure, the driven gear and the duct are arranged close to each other, and hence the electric propulsion device is made compact.

In the aforementioned electric propulsion device according to this aspect, the turning axis of the duct and the rotation axis of the turning actuator are preferably arranged substantially coaxially with each other. According to this structure, the duct and the turning actuator are arranged coaxially with each other and are aligned close to each other in the vertical direction. Consequently, the duct and the rim are integrally turned while significantly reducing an increase in the size of the electric propulsion device.

In the aforementioned electric propulsion device according to this aspect, the turning actuator is preferably arranged immediately above the duct. According to this structure, the duct and the turning actuator are easily aligned in the vertical direction, and hence the electric propulsion device is made compact.

In the aforementioned electric propulsion device according to this aspect, the bracket preferably supports the duct at two or more different positions of the duct. According to this structure, the bracket stably supports the duct, and hence the duct is stably turned about the turning axis.

In the aforementioned electric propulsion device according to this aspect, the rotation axis of the rim is preferably orthogonal to the turning axis of the duct. According to this structure, the structures of the rim and the duct are simplified.

In the aforementioned electric propulsion device according to this aspect, a turning shaft that rotates about the turning axis is preferably arranged at a substantially central position of the duct in the front-back direction of the electric propulsion device. According to this structure, the amount of protrusion of the turning shaft in the lateral direction of the duct is reduced when rotating the duct about the turning shaft.

In the aforementioned electric propulsion device according to this aspect, the turning actuator is preferably arranged at a substantially central position of the duct in the right-left direction of the electric propulsion device. According to this structure, the duct and the turning actuator are arranged compactly in a width direction, as viewed from the front.

In the aforementioned electric propulsion device according to this aspect, the turning actuator preferably includes an electric motor. According to this structure, the electric propulsion device is more compactly formed.

In the aforementioned electric propulsion device according to this aspect, the duct preferably includes a coil, and the electric propulsion device preferably further includes a wire to carry electrical current to the coil. According to this structure, electrical current is easily carried to the coil of the duct.

In this case, the duct preferably includes a connector to carry electrical current, and the wire is preferably arranged between the connector and the coil. According to this structure, electrical current is more easily carried to the coil of the duct by the connector.

In the aforementioned electric propulsion device according to this aspect, the duct is preferably asymmetric about a plane that is perpendicular to the extensional direction of the rotation axis of the rim and passes through a center position of the duct. According to this structure, the duct has directivity such that propulsive force is efficiently generated, and hence propulsive force is efficiently generated while significantly reducing an increase in the size of the electric propulsion device and integrally turning the duct and the rim.

In this case, the duct preferably turns within an angular range of 180 degrees or more about the turning axis in a plan view. According to this structure, the duct turns by at least 180 degrees about the turning axis, and hence the orientations of the duct and the rim are properly adjusted while integrally turning the duct and the rim.

In the aforementioned structure in which the duct turns within the angular range of 180 degrees or more about the turning axis in the plan view, the duct preferably turns within an angular range of 360 degrees or more about the turning axis in the plan view. According to this structure, the duct turns by at least 360 degrees about the turning axis, and hence the orientations of the duct and the rim are more freely adjusted while integrally turning the duct and the rim.

In the aforementioned structure in which the duct turns within the angular range of 360 degrees or more about the turning axis in the plan view, the duct preferably includes a coil, and the bracket preferably includes a connector to carry electrical current. In addition, the electric propulsion device preferably further includes a wire arranged between the connector and the coil to carry electrical current to the coil and a wire connected to the connector, arranged above the connector, and the duct preferably turns within an angular range of 720 degrees or less about the turning axis in the plan view. According to this structure, the orientations of the duct and the rim are more freely adjusted, and torsion of the wire that is connected to the connector and is arranged above the connector, resulting from rotation of the duct is significantly reduced or prevented.

In the aforementioned electric propulsion device according to this aspect, the duct and the rim are preferably stored in a boat body in a state where the duct and the rim are mounted on the bracket. According to this structure, when the duct and the rim are stored in the boat body, arrangement of the duct and the rim below the waterline is prevented during planing operation, and hence the resistance of the duct and the rim is significantly reduced during planing operation.

In the aforementioned electric propulsion device according to this aspect, the duct and the rim are preferably mounted on an outboard motor through the bracket. According to this structure, the duct and the rim are easily mounted on the outboard motor by the bracket to mount the turning actuator without providing another bracket separately.

In the aforementioned electric propulsion device according to this aspect, the duct and the rim are preferably integrally mounted on an outboard motor. According to this structure, the duct and the rim are mounted, utilizing a portion of the outboard motor as the bracket, and hence the number of components is reduced.

In the aforementioned structure in which the duct and the rim are mounted on the outboard motor through the bracket, the duct and the rim are preferably arranged above a cavitation plate of the outboard motor. According to this structure, arrangement of the duct and the rim below the waterline is prevented during planing operation, and hence the resistance of the duct and the rim is significantly reduced during planing operation.

The foregoing and other objects, features, aspects, and advantages of the present invention will become more apparent from the following detailed description of the present invention when taken in conjunction with the accompanying drawings.

BRIEF DESCRIPTION OF THE DRAWINGS

FIG. 15 is a diagram showing a turning actuator of an electric propulsion device according to a second embodiment of the present invention;

FIG. 16 is a diagram of the turning actuator of the electric propulsion device according to the second embodiment of the present invention, as viewed from above;

DESCRIPTION OF THE PREFERRED EMBODIMENT

Embodiments of the present invention are hereinafter described with reference to the drawings.

First Embodiment

The structure of an electric propulsion device 1 according to a first embodiment of the present invention is described with reference to FIGS. 1 to 14. In the figures, arrow FWD represents the forward movement direction of a boat body, and arrow BWD represents the reverse movement direction of the boat body.

Figure 1:
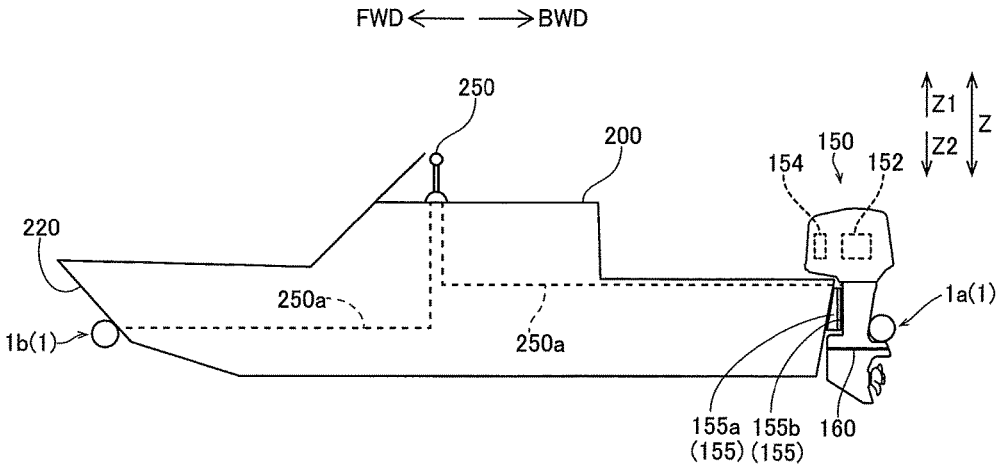
FIG. 1 is a diagram showing a boat body mounted with electric propulsion devices according to a first embodiment of the present invention.

As shown in FIG. 1, one electric propulsion device 1 is arranged on each of the front and back sides of a boat body 200. The electric propulsion device 1 on the back side is hereinafter referred to as the electric propulsion device 1*a*, and the electric propulsion device 1 on the front side is hereinafter referred to as the electric propulsion device 1*b*. The electric propulsion device 1*a* is mounted on an outboard motor 150 (a bracket 155 of the boat body 150) arranged on the back side of the boat body 200. The electric propulsion device 1*b* is mounted on a keel portion 220 on the front side of the boat body 200. The boat body 200 is provided with an operation portion 250 including a joystick or the like to operate the electric propulsion devices 1*a* and 1*b*. The operation portion 250 controls the start and stop of the operation of the electric propulsion devices 1*a* and 1*b* and controls turning angle adjustment.

Figure 2:
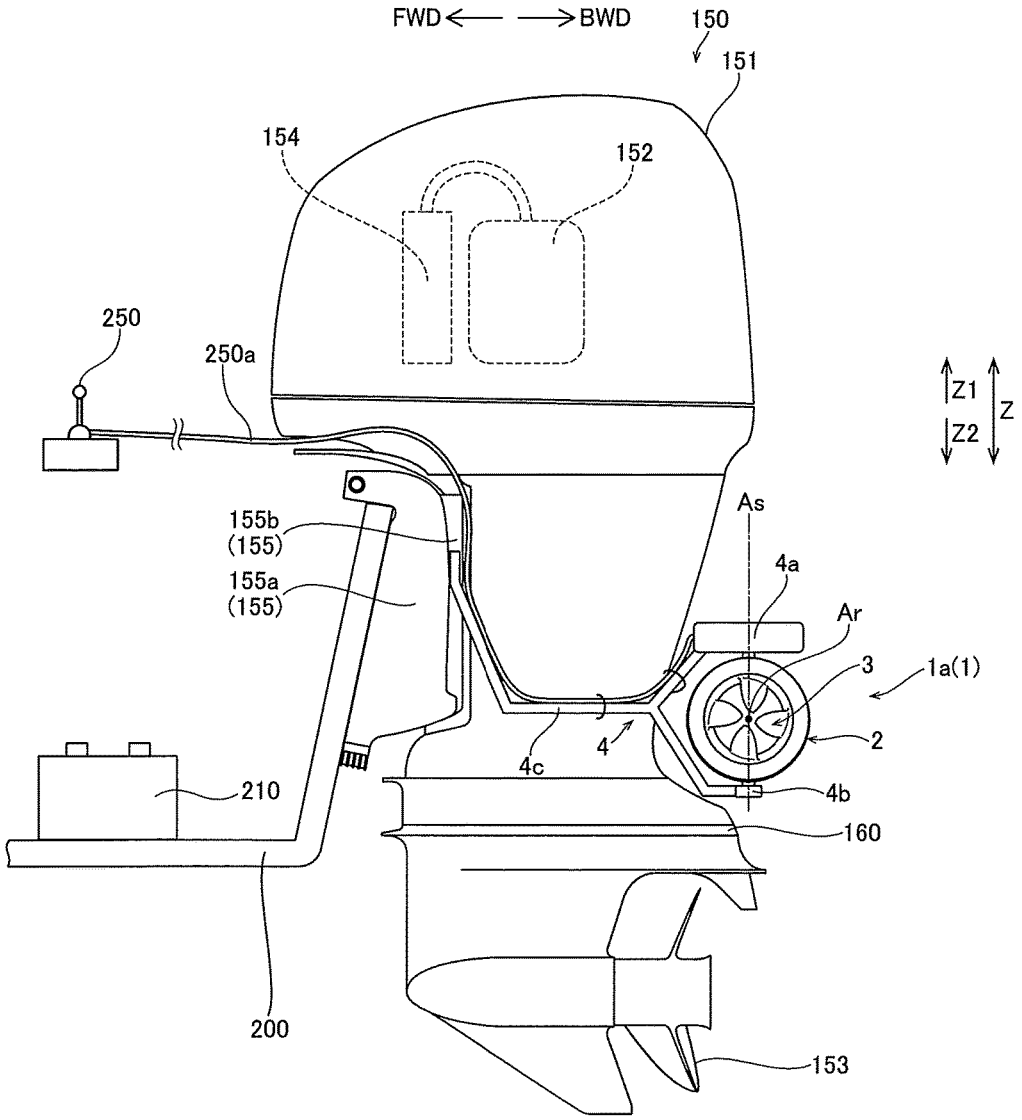
FIG. 2 is a diagram showing a state where an electric propulsion device according to the first embodiment of the present invention is mounted on an outboard motor.

As shown in FIG. 2, the outboard motor 150 includes a case portion 151, a power source 152, a propeller 153, and an ECU (electronic control unit) 154. Electric power is supplied from a battery 210 arranged in the boat body 200 to the power source 152 and the ECU 154 through an unshown wire. The outboard motor 150 is mounted on the boat body 200 through the bracket 155 including a clamp bracket 155*a* and a swivel bracket 155*b*. More specifically, the outboard motor 150 is mounted on the swivel bracket 155*b*. The clamp bracket 155*a* is fixed to the boat body 200, and the swivel bracket 155*b* is tilted with respect to the clamp bracket 155*a*. Thus, the outboard motor 150 is tilted with respect to the clamp bracket 155*a*. The outboard motor 150 is mounted on the swivel bracket 155*b* so as to turn with respect to the swivel bracket 155*b*.

The power source 152 rotates the propeller 153 through an unshown driving force transmission mechanism (a drive shaft, a propeller shaft, or the like). The power source 152 includes a motor, for example. Alternatively, the power source 152 may be an engine.

The ECU 154 includes a CPU, a storage portion, etc. The ECU 154 controls the operation of the outboard motor 150.

The structure of the electric propulsion device 1*a* on the back side is now described.

Figure 3:
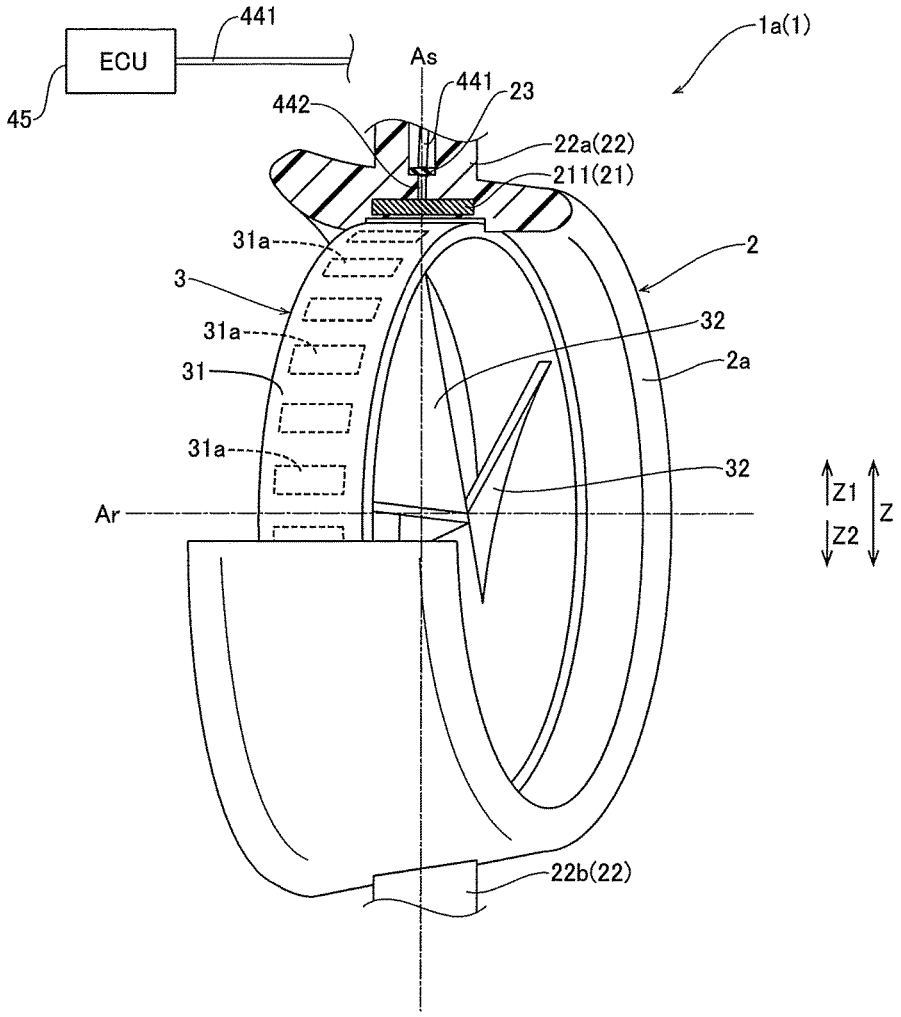
FIG. 3 is a perspective sectional view showing a duct and a rim of the electric propulsion device according to the first embodiment of the present invention.

As shown in FIG. 3, the electric propulsion device 1*a* includes a duct 2, a rim 3, and a bracket 4 (see FIG. 2). The electric propulsion device 1*a* is a radial gap motor including the duct 2 that defines a stator and the rim 3 that defines a rotor. The rim 3 and the duct 2 are arranged above a cavitation plate 160 (see FIG. 2) of the outboard motor 150.

The duct 2 has a cylindrical shape opened to two sides of a first side and a second side opposite to the first side. Furthermore, the duct 2 has a cylindrical shape having an opening reduced in size from the first side toward the second side. The duct 2 is annularly formed, as viewed in an open direction. The duct 2 is asymmetric about a plane S (see FIG. 4) that is perpendicular (direction Z) to the extensional direction of the rotation axis Ar of the rim 3 and passes through a center position of the duct 2. The duct 2 includes a stator portion 21, a turning shaft 22, and a connector 23 to carry electrical current.

The stator portion 21 is annularly (see FIGS. 8 and 9) arranged inside a housing 2*a* of the duct 2. The stator portion 21 includes a coil 211.

The turning shaft 22 has turning shafts 22*a* and 22*b*. The turning shaft 22*a* is provided so as to protrude upward (along arrow Z1) from the outer surface of an upper portion of the housing 2*a*. The turning shaft 22*a* is a hollow shaft internally having a space where a wire 441 described later is arranged. The turning shaft 22*b* is provided so as to protrude downward (along arrow Z2) from the outer surface of a lower portion of the housing 2*a*. The turning shafts 22*a* and 22*b* are arranged such that the axes thereof are coaxial with each other (on a turning axis As). The turning shafts 22*a* and 22*b* are arranged at a substantially central position of the duct 2 in the front-back direction of the electric propulsion device 1*a*.

Figure 4:
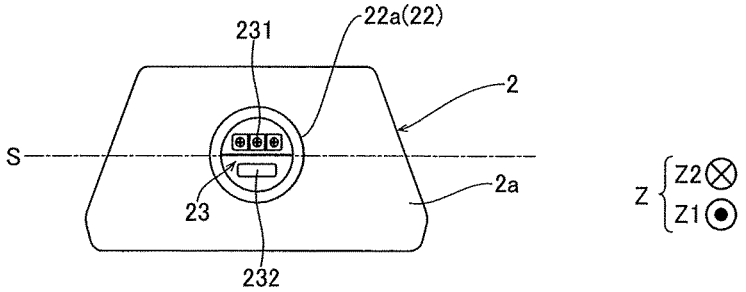
FIG. 4 is a diagram showing a connector of the electric propulsion device according to the first embodiment of the present invention.

The connector 23 is provided inside the housing 2*a* of the duct 2. The connector 23 is arranged inside the turning shaft 22*a*. The connector 23 is arranged above (along arrow Z1) the stator portion 21. As shown in FIG. 4, the connector 23 includes a wire connection portion 231 connected with wires 441 and 442 described later. The connector 23 also includes a wire connection portion 232. A wire to carry electrical current to parts provided in the duct 2 depending on the intended use is connectable to the wire connection portion 232.

As shown in FIG. 3, the rim 3 is arranged in an inner peripheral portion of the annular duct 2 and is rotatably held by the duct 2 so as to be integrally turnable or simultaneously turnable with the rim 3. The rim 3 rotates about a rotation axis Ar with respect to the duct 2. The rotation axis Ar of the rim 3 is orthogonal to the turning axis As of the duct 2. The rim 3 has a circular outer frame (rotor portion 31), as viewed along the rotation axis Ar. The rim 3 includes the rotor portion 31 and fins 32. The rim 3 and the duct 2 are mounted on the swivel bracket 155*b* (bracket 155) through the bracket 4 (see FIG. 2).

The rotor portion 31 includes a plurality of magnets 31*a* internally annularly arranged. The rim 3 defines a rotor rotatable by the rotor portion 31, relative to the duct 2 that defines a stator.

A plurality of fins 32 are provided. A clearance is formed between adjacent fins 32. The fins 32 are formed integrally with the rim 3 (rotor portion 31).

As shown in FIG. 2, the bracket 4 holds the duct 2 from above (along arrow Z1) and from below (along arrow Z2) to support the duct 2 at two different positions. The bracket 4 includes an upper portion 4*a*, a lower portion 4*b*, and mounting portions 4*c*.

Figure 5:
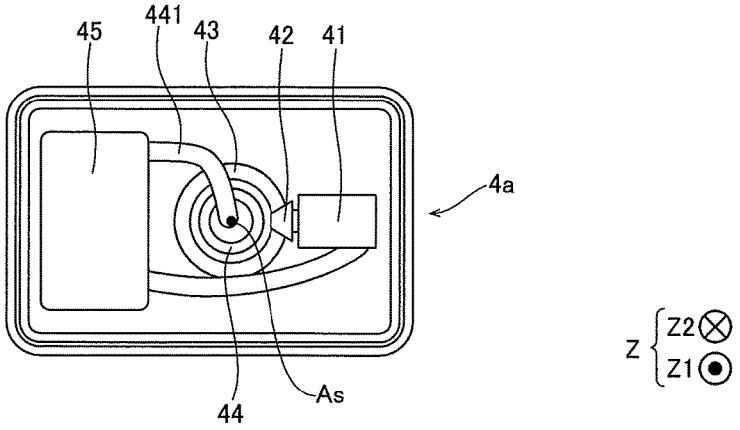
FIG. 5 is a diagram showing the inside of an upper portion of a bracket in an electric propulsion device on the back side according to the first embodiment of the present invention.

A lower surface portion of the upper portion 4*a* includes a bearing portion 41*a* (see FIG. 8) made of resin. The upper portion 4*a* rotatably supports the turning shaft 22*a* of the duct 2 from above by the bearing portion 41*a*. As shown in FIG. 5, the upper portion 4*a* is provided with a turning actuator 41, a drive gear 42, a driven gear 43, a connection portion 44, an ECU 45, and a seal portion 46 (see FIG. 8).

Figure 6:
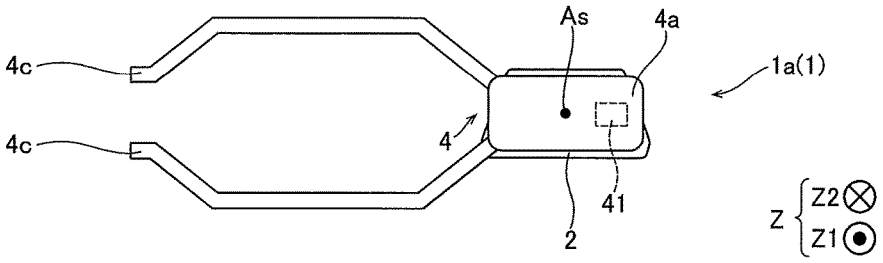
FIG. 6 is a plan view of the bracket of the electric propulsion device on the back side according to the first embodiment of the present invention.
Figure 7:
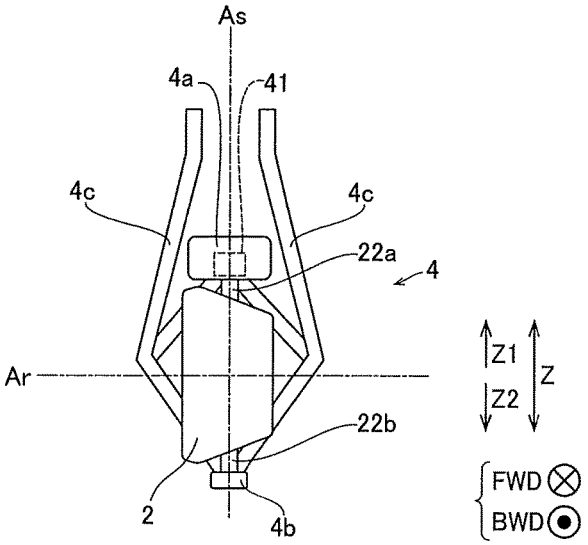
FIG. 7 is a diagram of the bracket of the electric propulsion device on the back side according to the first embodiment of the present invention, as viewed from the back.

The turning actuator 41 includes an electric motor such as a servomotor, for example. The turning actuator 41 is arranged such that the rotation axis thereof is parallel to a horizontal direction. As shown in FIG. 6, the turning actuator 41 is fixed to the bracket 4 and is arranged immediately above the duct 2. As shown in FIG. 7, the turning actuator 41 is arranged at a substantially central position of the duct 2 in the right-left direction of the electric propulsion device 1*a* (in the right-left direction as viewed in the front-back direction of the electric propulsion device 1*a*). The turning actuator 41 is arranged such that the rotation axis of an output shaft is substantially parallel to the horizontal direction, as shown in FIG. 8.

Figure 8:
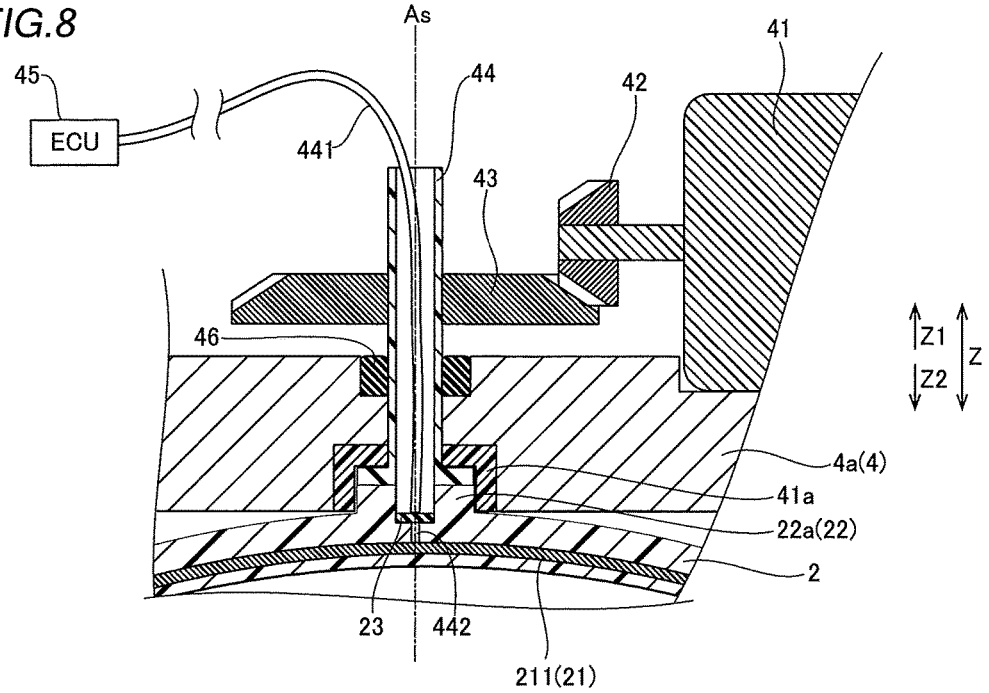
FIG. 8 is a diagram showing a turning shaft and a bearing portion in an upper portion of the electric propulsion device on the back side according to the first embodiment of the present invention.

As shown in FIG. 8, the drive gear 42 is mounted on the turning actuator 41. The turning actuator 41 drives the drive gear 42 so as to integrally turn the duct 2 and the rim 3. That is, "integrally turn" means that the duct 2 and the rim 3 are simultaneously turned by a same amount in a same direction.

The driven gear 43 is mounted on the duct 2. Specifically, the driven gear 43 is mounted on the duct 2 through the connection portion 44. The driven gear 43 is arranged above (along arrow Z1) the duct 2 in the vicinity of the duct 2. The driving force of the turning actuator 41 is transmitted to the driven gear 43 through the drive gear 42. The drive gear 42 and the driven gear 43 convert the driving force of the turning actuator 41 about the rotation axis parallel to the horizontal direction into driving force about the turning axis As (in a vertical direction). The connection portion 44 is fixed to the driven gear 43 at a center position (see FIG. 5) thereof in a plan view. The driven gear 43 rotates together with the connection portion 44 about the turning axis As.

An upper portion of the connection portion 44 is fixed to the driven gear 43, and a lower portion of the connection portion 44 is fixed to the turning shaft 22*a*. An unshown O-ring and an unshown gel insulator are provided between the connection portion 44 and the turning shaft 22*a*, and entry of external water through a clearance between the connection portion 44 and the turning shaft 22*a* is significantly reduced or prevented. The upper portion and the lower portion of the connection portion 44 have hollow shaft shapes whose outer diameters are different from each other. The connection portion 44 is formed such that the outer diameter of the upper portion is smaller than the outer diameter of the lower portion. The connection portion 44 is supported by the bracket 4 (upper portion 4*a*) so as to be rotatable about the turning axis As. The wire 441 to drive the rim is provided inside the connection portion 44. The wire 441 is connected to the connector 23 and is arranged above the connector 23. The wire 441 connects the ECU 45 and the connector 23. The wire 442 is arranged between the connector 23 and the coil 211. Electrical current is carried to the coil 211 of the stator portion 21 through the wires 441 and 442 such that the rim 3 rotates with respect to the duct 2. The seal portion 46 is arranged in the upper portion 4*a* so as to surround the upper portion of the connection portion 44. In FIGS. 3 and 8, the wire 442 is simplified.

As shown in FIGS. 2 and 8, the ECU 45 is connected to the operation portion 250 through a wire 250*a*. The ECU 45 controls electrical current applied to the wires 441 and 442 and controls the turning actuator 41 on the basis of the operation of the operation portion 250 of the boat body 200 by a user. The ECU 45 integrally turns the duct 2 and the rim 3 clockwise or counterclockwise in the plan view on the basis of the operation of the operation portion 250 of the boat body 200 by the user. The duct 2 and the rim 3 rotate by up to 720 degrees.

Figure 9:
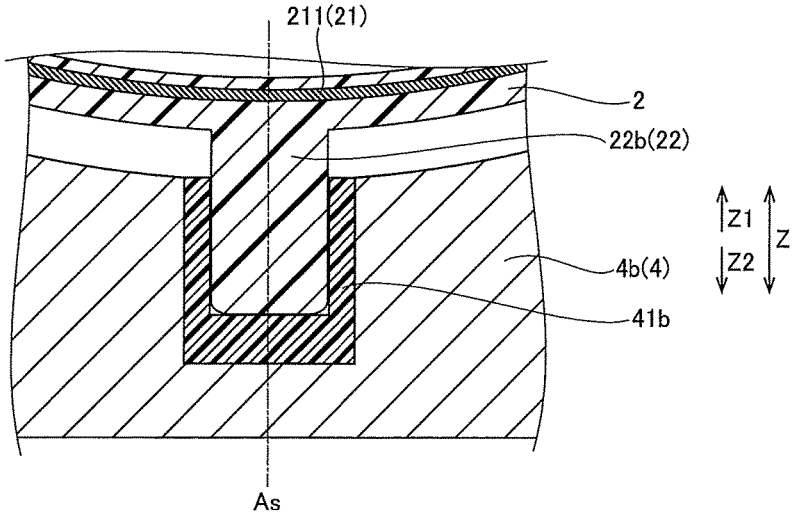
FIG. 9 is a diagram showing the turning shaft and the bearing portion in a lower portion of the electric propulsion device on the back side according to the first embodiment of the present invention.

As shown in FIG. 9, the lower portion 4*b* includes a bearing portion 41*b* made of resin. The lower portion 4*b* rotatably supports the turning shaft 22*b* of the duct 2 from below by the bearing portion 41*b*. The lower portion 4*b* and the upper portion 4*a* (see FIG. 8) support the duct 2 so as to allow the duct 2 to turn about the turning axis As that intersects with the rotation axis Ar of the rim 3. Thus, the duct 2 is turned relative to the bracket 4.

As shown in FIGS. 6 and 7, a pair of mounting portions 4*c* are provided. As shown in FIG. 2, respective back portions of the mounting portions 4*c* are connected to the upper portion 4*a* and the lower portion 4*b*. Front portions of the mounting portions 4*c* are mounted on the bracket 155 (swivel bracket 155*b*, see FIG. 2). Thus, the duct 2 and the rim 3 (electric propulsion device 1*a*) are tilted with respect to the clamp bracket 155*a* together with the outboard motor 150. The pair of mounting portions 4*c* each have such a width that the mounting portions 4*c* do not interfere with the outboard motor 150 when the outboard motor 150 is turned with respect to the swivel bracket 155*b*, as viewed from above. Thus, hindrance of the electric propulsion device 1*a* including the bracket 4 to tilting and turning the outboard motor 150 is reduced.

The structure of the electric propulsion device 1*b* on the front side is now described.

Figure 12:
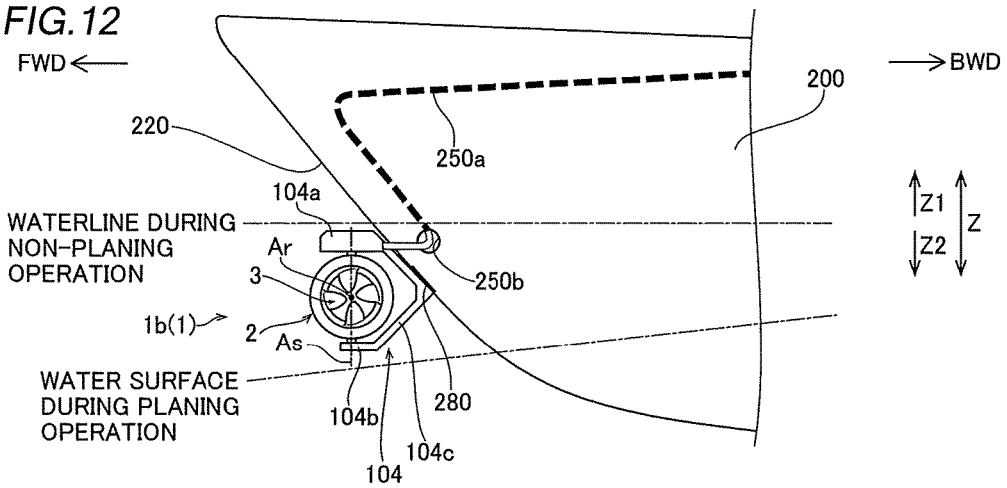
FIG. 12 is a diagram showing a state where an electric propulsion device on the front side according to the first embodiment of the present invention is mounted on a keel portion of the boat body.
Figure 13:
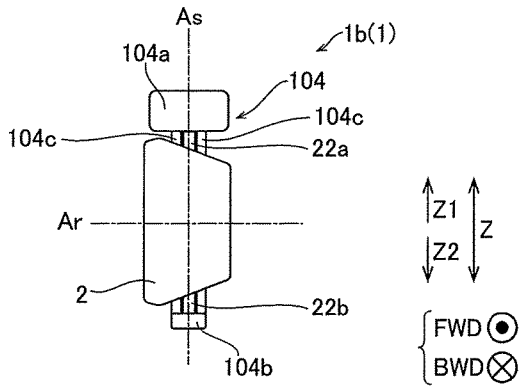
FIG. 13 is a diagram of the electric propulsion device on the front side according to the first embodiment of the present invention, as viewed from the front.
Figure 14:
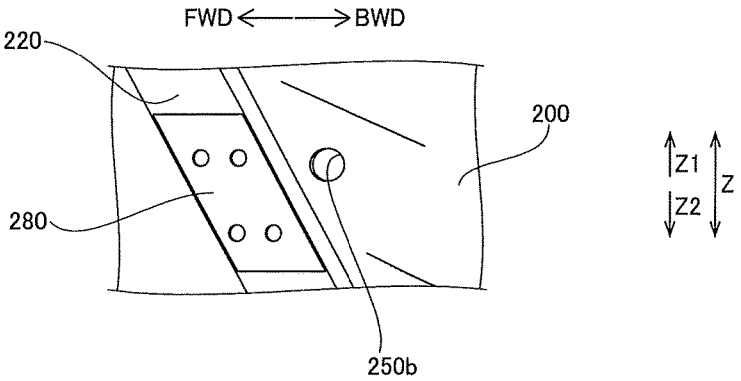
FIG. 14 is a diagram showing an electric propulsion device mounting portion to mount the electric propulsion device on the front side according to the first embodiment of the present invention.

As shown in FIG. 12, the electric propulsion device 1*b* includes a duct 2, a rim 3, and a bracket 104. The electric propulsion device 1*b* is a radial gap motor including the duct 2 and the rim 3. The electric propulsion device 1*b* basically has a structure similar to that of the electric propulsion device 1*a* (see FIG. 2), except for the different shape of the bracket 104. Thus, portions of the electric propulsion device 1*b* similar to those of the electric propulsion device 1*a* are denoted by the same reference numerals, to omit the description.

As shown in FIG. 12, the bracket 104 holds the duct 2 from above and from below so as to support the duct 2 at two different positions, similarly to the bracket 4. The bracket 104 includes an upper portion 104*a*, a lower portion 104*b*, and mounting portions 104*c*. The upper portion 104*a* and the lower portion 104*b* have structures similar to those of the upper portion 4*a* and the lower portion 4*b* of the electric propulsion device 1*a* on the back side, respectively. Thus, portions of the upper portion 104*a* similar to those of the upper portion 4*a* are denoted by the same reference numerals, to omit the description. Portions of the lower portion 104*b* similar to those of the upper portion 4*b* are denoted by the same reference numerals, to omit the description.

A pair of mounting portions 104*c* (see FIG. 13) are provided. As shown in FIG. 12, respective front portions of the mounting portions 104*c* are connected to the upper portion 104*a* and the lower portion 104*b*. Back portions of the mounting portions 104*c* are fixed to an electric propulsion device mounting portion 280 provided in the keel portion 220 of the boat body 200 by unshown screws. The wire 250*a* connects the ECU 45 (see FIG. 5) and the operation portion 250 through a hole 250*b* (see FIG. 14) provided in the boat body 200. The electric propulsion device 1*b* is mounted by the mounting portion 104*c* at a position where the rim 3 and the duct 2 are located below the waterline of the boat body 200 during non-planing operation (when the outboard motor 150 is not driven) and are located above a water surface during planing operation (when the outboard motor 150 is driven).

The turning operation of the duct 2 is now described.

Figure 10:
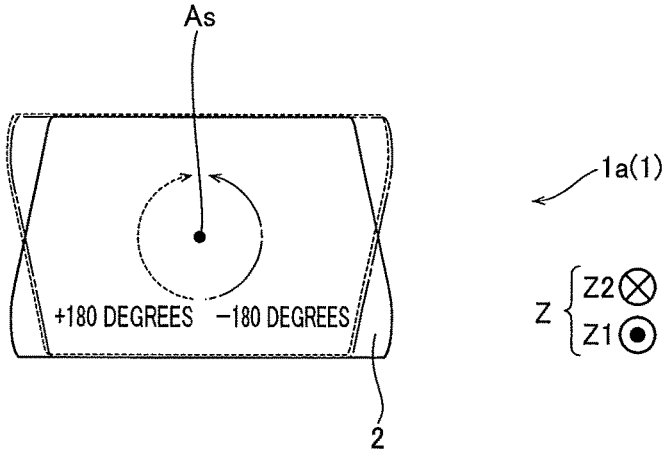
FIG. 10 is a diagram for illustrating a state where the electric propulsion device according to the first embodiment of the present invention has turned by 360 degrees about a turning axis.

As shown in FIG. 10, the duct 2 turns within an angular range of 180 degrees or more about the turning axis As in the plan view by control of the ECU 45 based on the operation of the operation portion 250 (see FIG. 1) of the boat body 200 by the user. Preferably, the duct 2 turns within an angular range of 360 degrees or more about the turning axis As in the plan view. More specifically, the duct 2 turns by 180 degrees clockwise and counterclockwise with respect to a reference position where the turning angle is 0 degrees. In FIG. 10, the duct 2 at the reference position is shown by a solid line, the duct 2 having turned by 180 degrees clockwise is shown by a dotted line, and the duct 2 having turned by 180 degrees counterclockwise is shown by a one-dot chain line.

Figure 11:
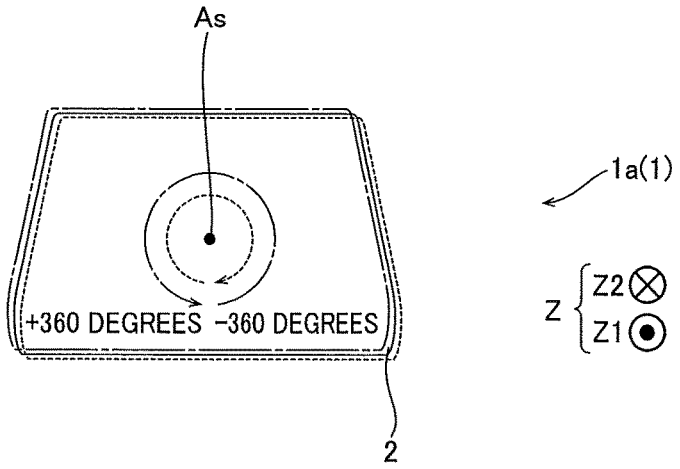
FIG. 11 is a diagram for illustrating a state where the electric propulsion device according to the first embodiment of the present invention has turned by 720 degrees about the turning axis.

As shown in FIG. 11, the duct 2 turns within an angular range of 720 degrees or less about the turning axis As in the plan view by control of the ECU 45 based on the operation of the operation portion 250 (see FIG. 1) of the boat body 200 by the user. More specifically, the duct 2 turns by 360 degrees clockwise and counterclockwise with respect to the reference position where the turning angle is 0 degrees. In FIG. 11, the duct 2 at the reference position is shown by a solid line, the duct 2 having turned by 360 degrees clockwise is shown by a dotted line, and the duct 2 having turned by 360 degrees counterclockwise is shown by a one-dot chain line.

According to the first embodiment, the following effects are obtained.

According to the first embodiment, the electric propulsion device 1 is configured as hereinabove described, whereby the turning actuator 41 integrally turns the duct 2 and the rim 3 so as to change the direction of generated propulsive force without providing a plurality of propellers. Furthermore, the duct 2 is turnable relative to the bracket 4 (the duct 2 is turned independently of the bracket 4) so as to change the direction of generated propulsive force. In addition, the turning actuator 41 fixed to the bracket 4 turns the duct 2 relative to the bracket 4, and hence the heights of the electric propulsion devices 1*a* and 1*b* in the vertical direction are significantly reduced, unlike the case where a steering shaft is provided so as to integrally turn the duct 2 and the rim 3. Consequently, the direction of generated propulsive force is changed while significantly reducing an increase in the sizes of the electric propulsion devices 1*a* and 1*b*.

According to the first embodiment, the electric propulsion device 1 is provided with the driven gear 43, the drive gear 42, and the turning actuator 41 that drives the drive gear 42 so as to integrally turn the duct 2 and the rim 3. Thus, unlike the case where a steering shaft is provided, the turning actuator 41 integrally turns the duct 2 and the rim 3 through the drive gear 42 and the driven gear 43, and hence the heights of the electric propulsion devices 1*a* and 1*b* in the vertical direction are significantly reduced.

According to the first embodiment, the driven gear 43 is arranged above the duct 2 in the vicinity of the duct 2. Thus, the driven gear 43 and the duct 2 are arranged close to each other, and hence the electric propulsion devices 1*a* and 1*b* are made compact.

According to the first embodiment, the turning actuator 41 is arranged immediately above the duct 2. Thus, the duct 2 and the turning actuator 41 are easily aligned in the vertical direction, and hence the electric propulsion devices 1*a* and 1*b* are made compact.

According to the first embodiment, the bracket 4 supports the duct 2 at the two different positions of the duct 2. Thus, the bracket 4 stably supports the duct 2, and hence the duct 2 is stably turned about the turning axis As.

According to the first embodiment, the rotation axis Ar of the rim 3 is orthogonal to the turning axis As of the duct 2. Thus, the structures of the rim 3 and the duct 2 are simplified.

According to the first embodiment, the turning shafts 22*a* and 22*b* that rotate about the turning axis As are arranged at the substantially central position of the duct 2 in the front-back direction of each of the electric propulsion devices 1*a* and 1*b*. Thus, the amount of protrusion of the turning shafts 22*a* and 22*b* in the lateral direction of the duct 2 is reduced when rotating the duct 2 about the turning shafts 22*a* and 22*b*.

According to the first embodiment, the turning actuator 41 is arranged at the substantially central position of the duct 2 in the right-left direction of each of the electric propulsion devices 1*a* and 1*b*. Thus, the duct 2 and the turning actuator 41 are arranged compactly in a width direction, as viewed from the front.

According to the first embodiment, the turning actuator 41 includes the electric motor. Thus, the electric propulsion devices 1*a* and 1*b* are more compactly formed.

According to the first embodiment, the coil 211 is provided in the duct 2, and the wire 442 is provided so as to carry electrical current to the coil 211. Thus, electrical current is easily carried to the coil 211 of the duct 2.

According to the first embodiment, the connector 23 to carry electrical current is provided in the duct 2, and the wire 442 is arranged between the connector 23 and the coil 211. Thus, electrical current is more easily carried to the coil 211 of the duct 2 by the connector 23.

According to the first embodiment, the duct 2 is asymmetric about the plane that is perpendicular to the extensional direction of the rotation axis Ar of the rim 3 and passes through the center position of the duct 2. Thus, the duct 2 has directivity such that propulsive force is efficiently generated, and hence propulsive force is efficiently generated while significantly reducing an increase in the sizes of the electric propulsion devices 1*a* and 1*b* and integrally turning the duct 2 and the rim 3.

According to the first embodiment, the duct 2 turns within the angular range of 180 degrees or more about the turning axis As in the plan view. Thus, the duct 2 turns by at least 180 degrees about the turning axis As, and hence the orientations of the duct 2 and the rim 3 are properly adjusted while integrally turning the duct 2 and the rim 3.

According to the first embodiment, the duct 2 turns within the angular range of 360 degrees or more about the turning axis As in the plan view. Thus, the duct 2 turns by at least 360 degrees about the turning axis As, and hence the orientations of the duct 2 and the rim 3 are more freely adjusted while integrally turning the duct 2 and the rim 3.

According to the first embodiment, the duct 2 turns within the angular range of 720 degrees or less about the turning axis As in the plan view. Thus, the orientations of the duct 2 and the rim 3 are more freely adjusted, and torsion of the wire 441 that is connected to the connector 23 and is arranged above the connector 23, resulting from rotation of the duct 2 is significantly reduced or prevented.

According to the first embodiment, the duct 2 and the rim 3 are mounted on the outboard motor 150 through the bracket 4. Thus, the duct 2 and the rim 3 are easily mounted on the outboard motor 150 by the bracket 4 to mount the turning actuator 41 without providing another bracket separately.

According to the first embodiment, the duct 2 and the rim 3 are arranged above the cavitation plate 160 of the outboard motor 150. Thus, arrangement of the duct 2 and the rim 3 below the waterline is prevented during planing operation, and hence the resistance of the duct 2 and the rim 3 is significantly reduced during planing operation.

Second Embodiment

The structure of an electric propulsion device 100 according to a second embodiment of the present invention is now described with reference to FIGS. 15 and 16.

In the second embodiment, the electric propulsion device 100 in which no driven gear 43 or drive gear 42 is provided is described, unlike the first embodiment in which the duct 2 and the rim 3 are turned through the driven gear 43 and the drive gear 42. Portions of the electric propulsion device 100 similar to those of the electric propulsion device 1 according to the aforementioned first embodiment are denoted by the same reference numerals, to omit the description.

One electric propulsion device 100 is arranged on each of the front and back sides of a boat body 200, similarly to the first embodiment. The electric propulsion device 100 on the back side is hereinafter referred to as the electric propulsion device 100*a*, and the electric propulsion device 100 on the front side is hereinafter referred to as the electric propulsion device 100*b*.

The structure of the electric propulsion device 100*a* on the back side is described.

As shown in FIG. 15, an upper portion 204*a* of a bracket 204 includes a turning actuator 241 and a coupling portion 242. The upper portion 204*a* includes a connection portion 44, an ECU 45, and a seal portion 46.

The turning actuator 241 includes an electric motor such as a servomotor, for example. The turning actuator 241 is an axial gap motor. The turning actuator 241 includes a lower housing 243, an upper housing 244, a stator portion 245, a rotor portion 246, and a magnet 247. The turning actuator 241 is fixed to the bracket 204 and is arranged immediately above the duct 2. The turning actuator 241 is arranged such that the rotation axis thereof is parallel to a substantially vertical direction. The rotation axis of the turning actuator 241 is arranged substantially coaxially with the turning axis As of the duct 2 (see FIG. 2).

The lower housing 243 is a casing having a bottom, opened upward.

The upper housing 244 is arranged on an upper portion of the lower housing 243. The stator portion 245, the rotor portion 246, etc. are stored in a space defined by the upper housing 244 and the lower housing 243.

The stator portion 245 is arranged on the upper surface of the lower housing 243. The stator portion 245 is annularly provided so as to surround the turning axis As. The stator portion 245 includes an unshown coil.

The rotor portion 246 is arranged at a prescribed interval in a vertical direction (direction Z) from the stator portion 245. The rotor portion 246 is annularly arranged so as to surround the turning axis As. The rotor portion 246 is plate-like. The magnet 247 is provided on the lower surface of the rotor portion 246. A coupling portion 248 is mounted on an inner peripheral portion 246*a* of the rotor portion 246.

The coupling portion 242 is mounted on the duct 2 through the connection portion 44. The coupling portion 242 is coupled (splined, see FIG. 16) to the coupling portion 248 of the rotor portion 246. The connection portion 44 is fixed to the coupling portion 242 at a center position in a plan view. The driving force of the turning actuator 241 is transmitted to the coupling portion 242 through the coupling portion 248. The coupling portion 242 rotates together with the connection portion 44 about the turning axis As. An upper portion of the connection portion 44 is fixed to the coupling portion 242, and a lower portion of the connection portion 44 is fixed to a turning shaft 22*a*. Thus, the turning actuator 241 integrally turns the duct 2 and the rim 3 through the coupling portions 242 and 248.

The remaining structure of the electric propulsion device 100 according to the second embodiment is similar to that of the electric propulsion device 1 according to the aforementioned first embodiment.

According to the second embodiment, the following effects are obtained.

According to the second embodiment, the electric propulsion device 100 is configured as hereinabove described, whereby the turning actuator 241 integrally turns the duct 2 and the rim 3 so as to change the direction of generated propulsive force without providing a plurality of propellers. Furthermore, the duct 2 is turned relative to the bracket 204 (the duct 2 is turned independently of the bracket 204) so as to change the direction of generated propulsive force. In addition, the turning actuator 241 fixed to the bracket 204 turns the duct 2 relative to the bracket 204, and hence the heights of the electric propulsion devices 100*a* and 100*b* in the vertical direction are significantly reduced, unlike the case where a steering shaft is provided so as to integrally turn the duct 2 and the rim 3. Consequently, the direction of generated propulsive force is changed while significantly reducing an increase in the sizes of the electric propulsion devices 100*a* and 100*b*.

According to the second embodiment, as hereinabove described, the turning axis As of the duct 2 and the rotation axis of the turning actuator 241 are arranged substantially coaxially with each other. Thus, the duct 2 and the turning actuator 241 are arranged coaxially with each other and are aligned close to each other in the vertical direction. Consequently, the duct 2 and the rim 3 are integrally turned while significantly reducing an increase in the sizes of the electric propulsion devices 100*a* and 100*b*.

The embodiments disclosed this time must be considered as illustrative in all points and not restrictive. The range of the present invention is shown not by the above description of the embodiments but by the scope of claims for patent, and all modifications within the meaning and range equivalent to the scope of claims for patent are further included.

For example, while the electric propulsion device 1 (1*a*, 1*b*) or 100 (100*a*, 100*b*) including the radial gap motor including the duct 2 that defines a stator and the rim 3 that defines a rotor is shown in each of the aforementioned first and second embodiments, the present invention is not restricted to this. According to the present invention, an electric propulsion device including an SR (Switched Reluctance) motor including a duct and a rim may alternatively be employed.

While the brackets 4 and 104 or the bracket 204 supports the duct 2 at the two different positions in each of the aforementioned first and second embodiments, the present invention is not restricted to this. According to the present invention, the bracket may alternatively support the duct at one or three or more positions.

While the duct 2 turns within the angular range of 180 degrees or more about the turning axis As in each of the aforementioned first and second embodiments, the present invention is not restricted to this. According to the present invention, the duct may alternatively turn only by less than 180 degrees about the turning axis.

While the duct 2 turns within the angular range of 720 degrees or less about the turning axis As in each of the aforementioned first and second embodiments, the present invention is not restricted to this. According to the present invention, the duct may alternatively turn within an angular range of more than 720 degrees about the turning axis.

Figure 17:
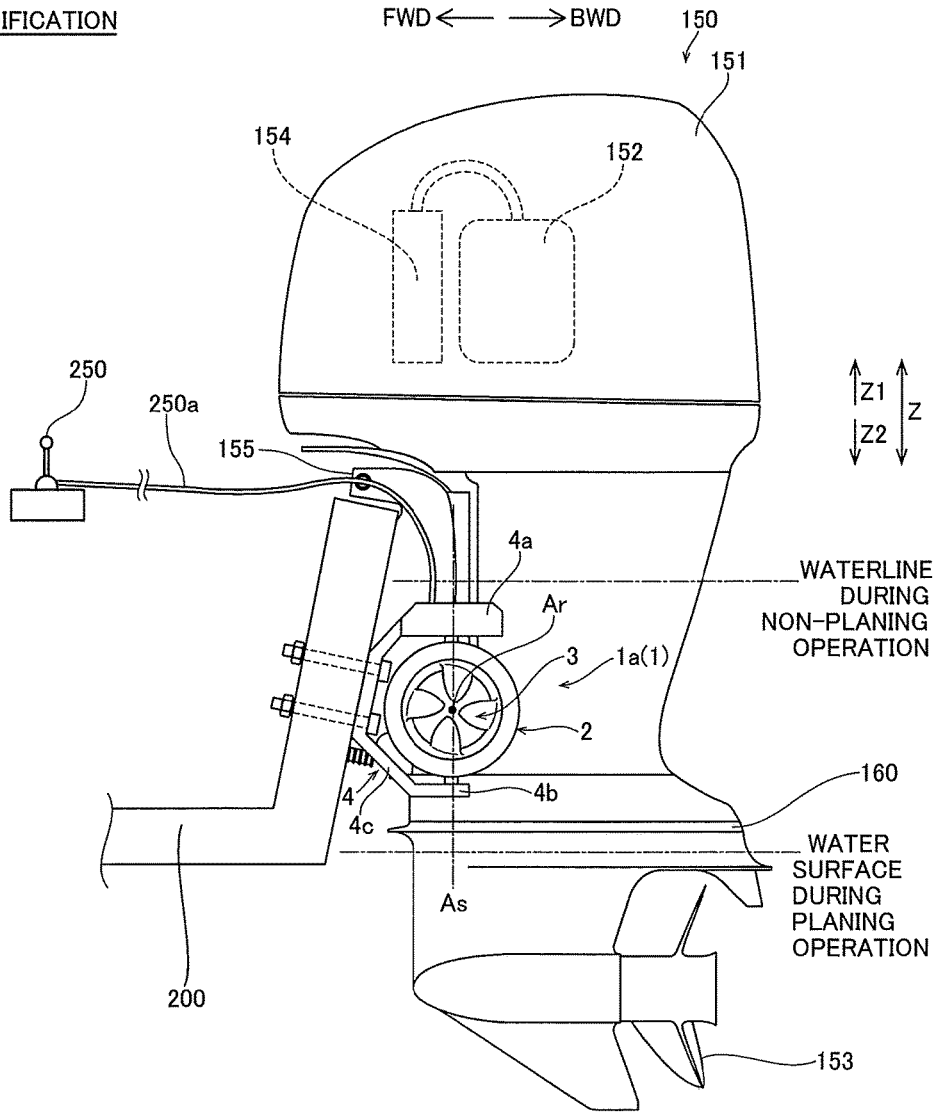
FIG. 17 is a diagram showing a state where an electric propulsion device on the back side according to a modification of the first embodiment of the present invention is mounted on a boat body.

While the duct 2 and the rim 3 of the electric propulsion device 1*a* or 100*a* are mounted on the outboard motor 150 (the bracket 155 of the outboard motor 150) through the bracket 4 or 204 in each of the aforementioned first and second embodiments, the present invention is not restricted to this. According to the present invention, the duct and the rim may alternatively be mounted on the boat body in a state where the same are mounted on the bracket 4, as shown in FIG. 17.

Figure 18:
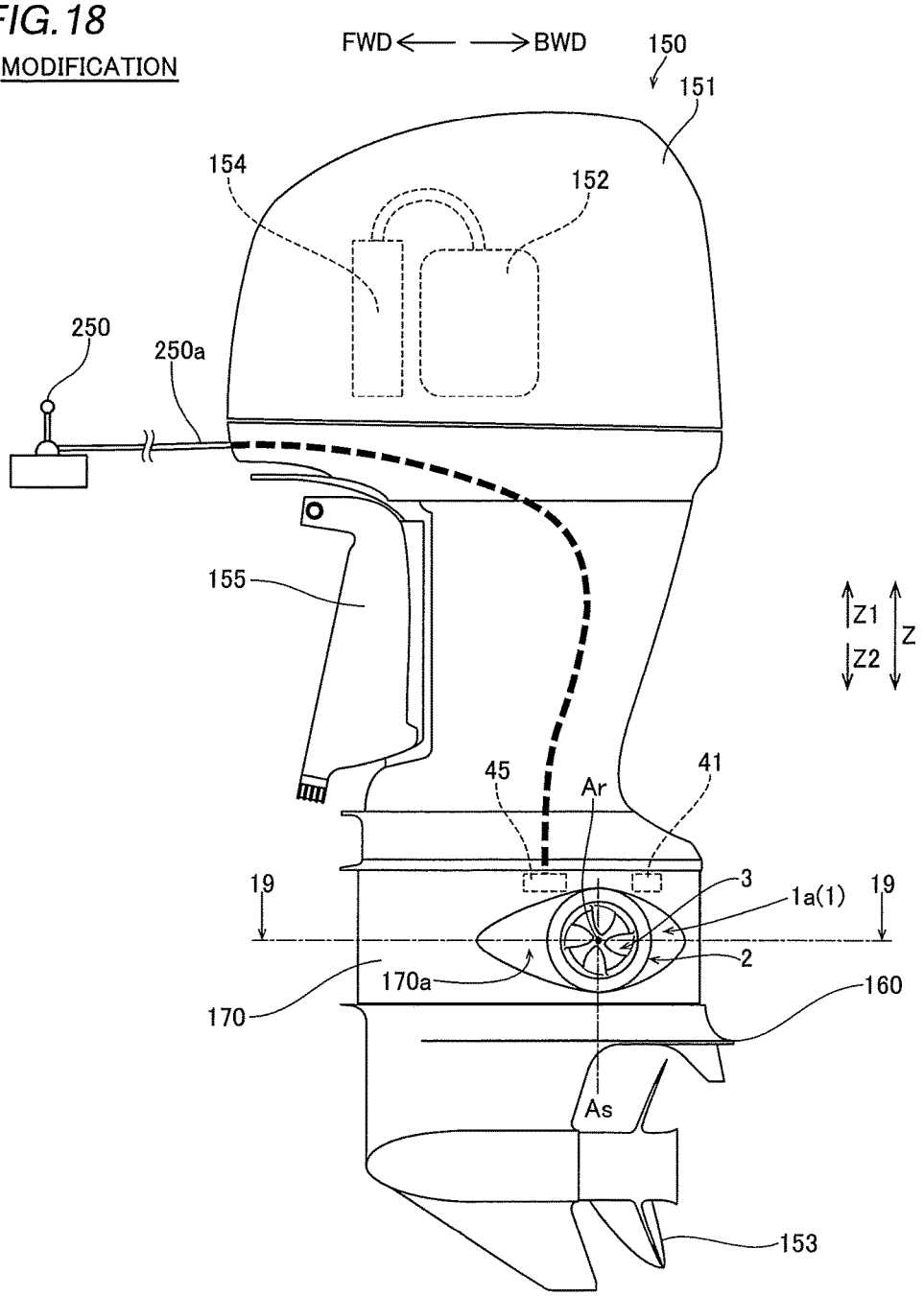
FIG. 18 is a diagram showing a state where an electric propulsion device on the back side according to another modification of the first embodiment of the present invention is mounted on a spacer case of an outboard motor.
Figure 19:
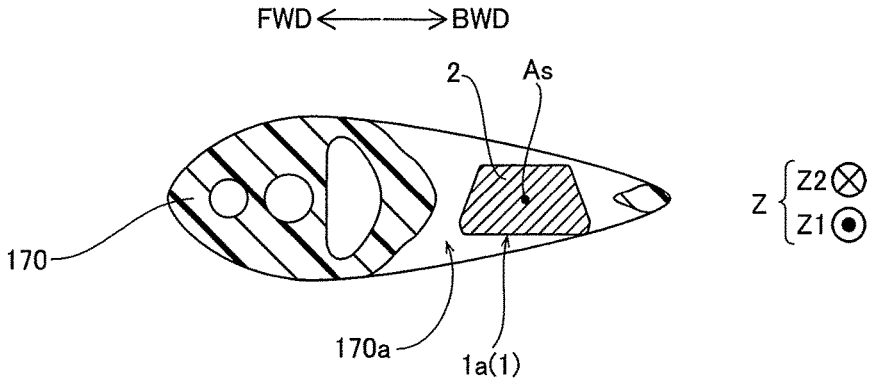
FIG. 19 is a schematic view taken along the line 19-19 in FIG. 18.

While the duct 2 and the rim 3 of the electric propulsion device 1*a* or 100*a* are mounted on the outside of the outboard motor 150 (the bracket 155 of the outboard motor 150) in each of the aforementioned first and second embodiments, the present invention is not restricted to this. According to the present invention, the duct and the rim may alternatively be integrally mounted on the outboard motor. More specifically, the duct and the rim may alternatively be mounted on a spacer case 170 of the outboard motor 150 that defines the bracket, as shown in FIGS. 18 and 19. The duct and the rim are arranged in a through-hole 170*a* of the spacer case 170 so as to be turnable. Thus, the duct and the rim are mounted, utilizing a portion of the outboard motor as the bracket, and hence the number of components is reduced. Furthermore, the duct and the rim are arranged, utilizing an empty space of the spacer case 170 of the outboard motor.

While the duct 2 and the rim 3 of the electric propulsion device 1*a* or 100*a* are mounted on the outside of the outboard motor 150 (the bracket 155 of the outboard motor 150) in each of the aforementioned first and second embodiments, the present invention is not restricted to this. According to the present invention, the duct and the rim may alternatively be mounted on a flap of the outboard motor that serves as the bracket.

Figure 20:
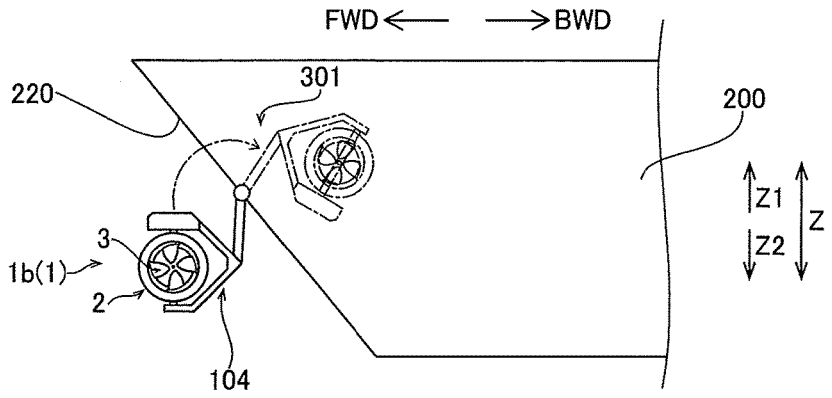
FIG. 20 is a diagram showing a rotary storage mechanism to store an electric propulsion device according to still another modification of the first embodiment of the present invention in a boat body.
Figure 21:
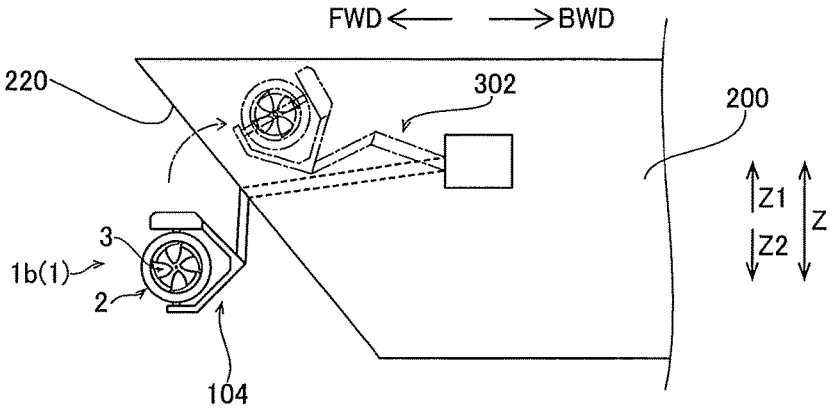
FIG. 21 is a diagram showing a retractable storage mechanism to store an electric propulsion device according to yet another modification of the first embodiment of the present invention in a boat body.

While the duct 2 and the rim 3 of the electric propulsion device 1*b* or 100*b* are fixed to the keel portion 220 of the boat body 200 in each of the aforementioned first and second embodiments, the present invention is not restricted to this. According to the present invention, the duct and the rim may alternatively be stored in the boat body in a state where the same are mounted on the bracket. In this case, the duct 2 and the rim 3 may be stored in the boat body 200 in a state where the same are mounted on the bracket 104 by a rotary storage mechanism 301 or a retractable storage mechanism 302, as shown in a modification in each of FIGS. 20 and 21. When the duct 2 and the rim 3 are stored in the boat body 200, arrangement of the duct 2 and the rim 3 below the waterline is prevented during planing operation, and hence the resistance of the duct 2 and the rim 3 is significantly reduced during planing operation.

What is claimed is:

1. An electric propulsion device comprising:

a duct having a cylindrical shape and that includes a stator;

a rim including a rotor rotatable relative to the duct, and a plurality of fins;

a bracket that supports the duct so as to allow the duct to turn about a turning axis that intersects with a rotation axis of the rim; and a turning actuator that simultaneously turns the duct and the rim, the turning actuator being fixed to the bracket and being in an actuator housing that, in a plan view, occupies a same space as a space occupied by the duct, and wherein the duct is turnable relative to the bracket, and the actuator housing is arranged adjacent to the duct outside a boat body.

2. The electric propulsion device according to claim 1, further comprising:

a driven gear mounted on the duct; and a drive gear that drives the driven gear, wherein the turning actuator drives the drive gear so as to simultaneously turn the duct and the rim.

3. The electric propulsion device according to claim 2, wherein the driven gear is arranged above the duct in a vicinity of the duct.

4. The electric propulsion device according to claim 1, wherein the turning axis of the duct and a rotation axis of the turning actuator are arranged substantially coaxially with each other.

5. The electric propulsion device according to claim 1, wherein the turning actuator is arranged immediately above the duct.

6. The electric propulsion device according to claim 1, wherein the bracket supports the duct at two or more different positions of the duct that are on at least two opposite sides from each other.

7. The electric propulsion device according to claim 1, wherein the rotation axis of the rim is orthogonal to the turning axis of the duct.

8. The electric propulsion device according to claim 1, further wherein the duct includes a turning shaft that rotates about the turning axis and is arranged at a substantially central position of the duct in a front-back direction of the electric propulsion device.

9. The electric propulsion device according to claim 1, wherein the turning actuator is arranged at a substantially central position of the duct in a right-left direction of the electric propulsion device.

10. The electric propulsion device according to claim 1, wherein the turning actuator includes an electric motor.

11. The electric propulsion device according to claim 1, wherein the duct includes a coil, and the electric propulsion device further comprises a wire to carry electrical current to the coil.

12. The electric propulsion device according to claim 11, wherein the duct includes a connector to carry electrical current, and the wire is arranged between the connector and the coil so as to electrically connect the connector and the coil.

13. The electric propulsion device according to claim 1, wherein the duct is asymmetric about a plane that is both perpendicular to an extensional direction of the rotation axis of the rim, and passes through a center position of the duct.

14. The electric propulsion device according to claim 13, wherein the duct turns within an angular range of 180 degrees or more about the turning axis in the plan view.

15. The electric propulsion device according to claim 13, wherein the duct turns within an angular range of 360 degrees or more about the turning axis in the plan view.

16. The electric propulsion device according to claim 15, wherein the duct includes a coil, and the bracket includes a connector to carry electrical current, the electric propulsion device further comprises:

a first wire arranged between the connector and the coil to carry the electrical current to the coil; and a second wire connected to the connector and arranged above the connector, the second wire providing the electrical current to the connector, wherein the angular range that the duct turns within is 720 degrees or less about the turning axis in the plan view.

17. The electric propulsion device according to claim 1, wherein the duct and the rim are stored in a boat body in a state where the duct and the rim are mounted on the bracket.

18. The electric propulsion device according to claim 1, wherein the duct and the rim are mounted on an outboard motor through the bracket.

19. The electric propulsion device according to claim 18, wherein the duct and the rim are arranged above a cavitation plate of the outboard motor.

20. The electric propulsion device according to claim 1, wherein the duct and the rim are mounted in a through hole of an integrally formed spacer case of an outboard motor.

* * * * *